United States Patent [19]

Engall

[11] 4,132,366

[45] Jan. 2, 1979

[54] INFEED TUBE FOR DISC REFINERS

[75] Inventor: Fred Engall, Brantford, Canada

[73] Assignee: The Bauer Bros. Co., Springfield, Ohio

[21] Appl. No.: 803,068

[22] Filed: Jun. 3, 1977

[51] Int. Cl.[2] ..... B02C 7/06

[52] U.S. Cl. ..... 241/245; 241/251

[58] Field of Search ..... 241/244, 245, 248, 250, 241/251

[56] References Cited

U.S. PATENT DOCUMENTS

| | | | |
|---|---|---|---|
| 1,795,603 | 3/1931 | Hussey | 241/251 X |
| 2,561,043 | 7/1951 | Ayers | 241/245 X |
| 3,273,809 | 9/1966 | Horstman | 241/244 |
| 3,441,227 | 4/1969 | Fisher | 241/244 UX |
| 3,845,910 | 11/1974 | Cledaniel | 241/245 |

FOREIGN PATENT DOCUMENTS

| | | | |
|---|---|---|---|
| 2442627 | 3/1975 | Fed. Rep. of Germany | 241/245 |

*Primary Examiner*—Howard N. Goldberg
*Attorney, Agent, or Firm*—Jerome P. Bloom

[57] ABSTRACT

The invention provides an infeed structure for a disc type refiner including a body having two passages which at their one ends commonly open from a portion of the body which is adapted to bridge an inlet opening to the interior of a disc type refiner. One of the passages is a material infeed passage and the other a steam vent passage. Incorporated in the portion of the body adapted to bridge the inlet opening to a disc refiner are means, preferably integrated, which in the application of the infeed structure serve to distinctly separate the discharge end of the material infeed passage from the inlet end of the steam vent passage. The discharge end of the material infeed passage is distinguished by a scroll-like configuration which faces outwardly of the body of the infeed structure and is formed by means which facilitate the direction of the material being fed to an optimum location within the inlet of the related refiner facilitating the full insuction of said material and movement thereof past reversely flowing steam which in accordance with the invention will exit by way of said steam vent passage.

17 Claims, 9 Drawing Figures

INFEED TUBE FOR DISC REFINERS

BACKGROUND OF THE INVENTION

This invention relates to a new and improved infeed tube for a disc-type refiner which has a well-defined compound function. Embodiments provide for the material to be refined to be smoothly and surely directed to and through the refiner inlet and, at the same time, for steam developed in the operation of the refiner to have its own separate venting path, the direction of which is that naturally developed by the steam yet substantially clear of interference with the material entering the refiner inlet. As applied the invention embodiments provide disc-type refiners which are more efficient and satisfactory in use and more economical to operate.

Disc refining is an old and well developed art, particularly in the pulp and paper industry. Much of the development in this art has been, hopefully, in the direction of greater and better utilization of the materials available to be refined and a reduction of the power required for proper refining. Improvements have been achieved in these respects but they have not by any means produced consistently satisfactory results. A basic problem which continues to exist in the art of disc refining stems from the fact that such excess steam as is normally developed in the disc refining process will backflow into the eye of the refiner and in many cases interfere with and sometimes even block the infeed of material to be refined. This not only interferes with the refining operation but reduces the quality of the refined product and increases the power and maintenance requirements for the operation of the refiner.

The relief of steam from the interior of the refiner has been effected in many ways, such as by applying a venting tube as in the case of the U.S. Pat. No. 2,561,043 or by modifying the body of a refiner disc in a manner somewhat as illustrated in the French Pat. No. 2,183,928. There have been many variations on this theme but all in the same general category, providing for a diversion of steam developed in a refiner in a manner which basically works against the natural inclination of movement of the steam. For one reason or another, the solutions of the prior art directed to the problems above noted have not proven to be fully satisfactory.

It is to a satisfactory solution of the above noted problems in the refining art that the present invention was and is directed.

SUMMARY OF THE INVENTION

The present invention provides an improved infeed tube for a disc refiner which embodies a scroll-type infeed passage, and at the same time a separate and distinct steam vent passage. In the application of the infeed tube to the inlet of a refiner the discharge end of the scroll-type infeed passage presents in facing relation to the interior of the refiner a helically developed surface the longitudinal arcuate extent of which is substantially 225° and formed on substantially uniform radius. The discharge end of this helically developed surface is continued by a projection which extends beyond the end of the infeed tube which connects to a refiner inlet to positively lead material into the operating influence of the rotating refiner disc to which it functionally relates. This helically developed discharge end of the infeed passage is formed about a portion of a tubular bearing arranged to accommodate the projection therethrough of a drive shaft of said rotating disc of the related refiner. A partition is embodied so as to be integral with the infeed tube and to clearly define, in combination with this tube a distinct separation between the discharge end of the infeed passage and the inlet end of the vent passage, both of which are arranged to commonly communicate with the opening defined by the refiner inlet. The arrangement is such that in the application of the infeed tube the applied drive shaft contributes to defining a controlled path of movement for the material directed through and from the infeed passage which inhibits any significant portion thereof from moving past the shaft and into the vent passage.

Both the material infeed and the vent passage are formed to expand in a sense outwardly and away from the ends thereof applied directly to a refiner inlet. The form and volume of the vent passage, as compared to that of the infeed passage, insures there will be much less resistance to flow of steam outwardly through the vent passage than through the infeed passage. Also, due to the low pressure drop characteristic of the vent passage, should particles of the fed material inadvertently move into the vent passage, such particles will be readily extracted under centrifugal force influences directed thereto by way of the refiner inlet.

Nozzles, the discharge ends of which are formed in and applied in connection with the exposed and scroll-like helical configuration of the discharge end of the material infeed passage, provide jets so located and directed as to influence all particles of material being fed to move to and into the related refiner in a positive fashion.

The unobvious results and advantages of the application of an infeed tube in accordance with the invention is a more economical installation and operation of a disc-type refiner.

It is therefore a primary object of the invention to provide improvements in infeed tubes for disc refiners rendering them more efficient and satisfactory in use, adaptable to a wider variety of applications and unlikely to malfunction.

A further object of the invention is to provide improvements in infeed tubes for disc-type refiners wherein the tube is formed to embody both a material infeed and a steam vent passage the arrangement of which is such that the material being fed to the inlet of a related refiner is distinctly separated from steam being vented from the refiner by way of its inlet.

Another object of the invention is to provide an infeed tube arrangement for a disc-type refiner wherein the material infeed passage has a scroll-like configuration.

An additional object of the invention is to provide a new and improved infeed tube for a disc-type refiner and a refiner assembly embodying the same possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein one but not necessarily the only form of embodiment of the invention is illustrated, FIG. 1 is a generally diagrammatic sectional view of a double disc refiner to which the infeed tube of the invention is applied;

Like parts are indicated by similar characters of reference throughout the several views.

Figure 1:
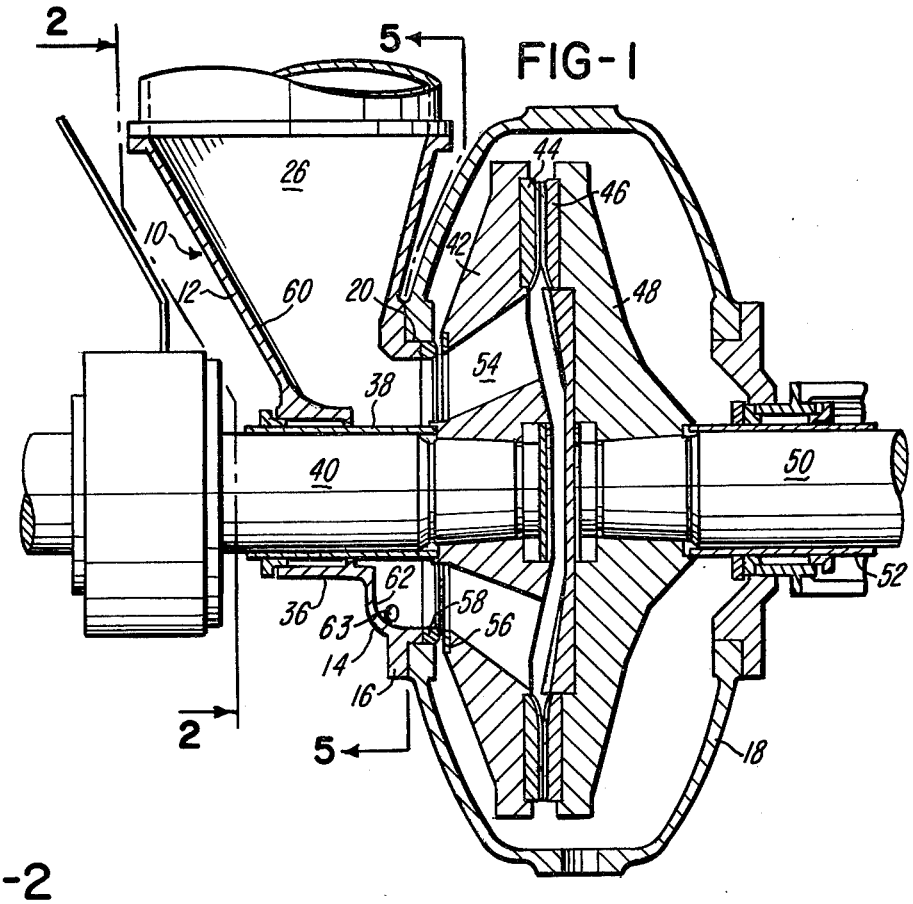

The infeed tube of the invention comprises a body 10 including a vertically disposing section 12 and, at the lower end thereof, a short horizontally disposing section 14 bent at essentially a right angle to the section 12. In a vertical sense the outer wall of the body section 14 has a generally circular configuration and it is circumscribed by an external flange 16 located adjacent but spaced inwardly of its projected extremity 15. In the application of the infeed tube to a disc type refiner, such as shown in FIG. 1 of the drawings, the projected extremity of the section 14 nests within that portion of the refiner housing 18 which defines its inlet opening 20. At the same time flange 16 seats and is secured to a flat circular outer surface portion of the housing which rims the refiner inlet. Suitable seals are provided between the facing surfaces of the coupled parts.

As illustrated, the housing 18 represents the body of a double disc refiner and contains a pair of opposed refiner discs 42 and 48 the operating faces of which each mount a band of refiner plates 44, 46 on the outer peripheral portion thereof. These refiner plates provide the disc refining surfaces which position in an opposed closely spaced facing relation, to rim a central material receiving space between the discs providing the eye of the refiner. The infeed disc 42, which mounts on one extremity of a horizontal drive shaft 40 projected interiorly of the housing 18 through the center of the inlet 20 is formed with a plurality of material infeed passages 54. The passages 54 are arranged in a circularly spaced pattern immediately about and in concentric relation to the central opening in the disc 42 which accommodates the shaft 40. As the disc 42 is positioned, the infeed ends of its passages 54 are located in immediately facing relation to the projected extremity 15 of the body section 14 nested in and bearing against the wall surface defining the refiner inlet 20. The passages 54 are conventionally arranged to conically diverge from the rear face of the disc 42 which is immediately adjacent the side wall of the housing 18 which includes the inlet 20 to its operating face. As seen, the discharge ends of the passages 54 open from the operating face of the disc 42 at a location immediately within the inner periphery of the refiner plates 44.

The rear face of disc 42 is formed with a recessed shoulder 56 which immediately bounds the material infeed ends of the passages 54 and disposes in a facing closely spaced relation to the projected extremity 15 of the body section 14. Fixed to the shoulder 56 is a sealing ring which faces and has a very close operating clearance with respect to a companion sealing ring 58 fixed within the inlet 20 and against the projected extremity 15 of the body section 14. In the rotation of the disc 42 the clearance between the sealing rings described is so limited as to inhibit passage therebetween of material being fed to the passages 54 by way of the inlet opening 20.

The disc 48 is fixedly mounted to one end of a drive shaft 50 which projects interiorly of the housing 18 through suitable axially extended bearing, including a bearing sleeve 52, provided in the side wall of the housing opposite that including the inlet opening 20.

Since further details of the refiner and its components are not required for an understanding of the present invention they are neither shown nor herein described.

It is to be understood that in referring to a particular orientation or attitude of the infeed tube 10 or any of its parts that reference is made to the orientation and attitude shown in FIG. 1 of the drawings.

The uppermost end 28 of the section 12 of the infeed tube includes a peripheral external flange and presents a planar surface having two openings of circular configuration, one of which is formed with a much larger radius than the other. The smaller of these openings provides the entrance end of a material infeed passage 24 which extends downwardly through and to one side of the section 12, the length thereof, reducing in cross section so as to have a downwardly convergent configuration. The larger of these openings provides the discharge end of a steam vent passage 26 the inner wall 60 of which extends downwardly of an opposite side portion of the section 12, very gradually reducing in cross section, providing that it also has a downwardly convergent configuration. The two passages 24 and 26 are spaced by an intermediate partition 25 which extends downwardly of the section 12, slightly inclined to a vertical. The lowermost end of the partition 25 is intercepted by and integrated with one side of the upper surface of a horizontal tubular wall segment 36 projected inwardly of the section 12 at its lowermost end. The segment 36 is formed integral with the wall portion of section 12 most remote from the inlet 20 of the refiner to which the infeed tube is applied, to rim an opening therein which is coaxial with and exposed to the opening defined by the projected extremity 15 of the section 14. The segment 36 serves to accommodate the projection therethrough of a bearing sleeve 38 and the shaft 40, one end of which extends through the section 14 and the inlet opening 20 to mount the disc 42 in the housing 18 and the other end of which extends through the lower end of the section 12 and from the infeed tube to its drive motor (not shown). Conventional sealing means are inserted between the segment 36 and the sleeve 38.

The lowermost end of the partition 25 in the section 12 has a lateral co-planar extension 68 which projects into and through the section 14, the tubular form of which defines a passage commonly continuing the lower ends of the passages 24 and 26 in the section 12. The extension 68 projects outwardly of the end 15 of section 14 to an extent that in application of the tube 10 to the housing 18 the projected extremity of the extension 68 will position in a plane immediately of the surface portion of the disc 42 which includes the entrance ends of the infeed passages 54. The form of the extension 68 is such to overlap the inwardly projected extremity of tube segment 36 and to have the lowermost edge of this overlapped portion curved and so positioned that it forms, within the limits thereof, a continuation of the innermost wall surface portion of segment 36 in the section 14. As so provided, the projection 68 forms a vertically inclined partition in the annular space defined about the shaft 40 and its bearing sleeve 38 as they are projected through the section 14 in the application of the tube 10 to the refiner housing 18. The orientation of the partition 25 and its inclination is such that the lower edge of extension 68 terminates substantially at or immediately adjacent to the horizontal diametral plane of section 14 which is also that of the tube segment 36.

As shown in the drawings, the infeed tube 10 may be split in the horizontal diametral plane of the section 14 for convenience of manufacture. However, since this is a mere mechanical expedient having no particular significance with respect to the basic concept of the invention, its inclusion in the embodiment illustrated will not be specifically described.

The downwardly converging wall surface forming the portion of passage 24 defined in part by the partition 25 has the lower end thereof which opens to the section 14 formed to commence a spiral curve directed about and in a sense axially of and from the tube segment 36. The portion of this wall surface most remote from the end 15 of the section 14 has the spiral curve at its lower end continued by a back or end wall portion 62 of the section 14. The surface of the wall portion 62 innermost of the section 14 curves in helical fashion through a uniform arc the extent of which is approximately 180°, in the process of which it gradually approaches and finally reaches the projected extremity 15. As will be seen in the drawings, the helical curve of this forwardly facing surface of wall 62 axially advances in such fashion that it reaches the projected extremity 15 at a point slightly in excess of 90° beyond the lower end of the plate extension 68, which coincides with the lowermost extremity of the passage 24 in the section 12. From this point the helically developed surface which faces outwardly of the section 12 is continued on the radially innermost side 64 of a projection 66 integral with and projected forwardly from the back wall 62. The axial extent of projection 66 beyond the extremity 15 of the section 14 is such to bring its projected planar extremity to a plane immediately adjacent that portion of disc 42 including the entrance ends of the infeed passages 54, as the tube 10 is applied to the refiner housing 18.

In a transverse sense, it will be seen that the radially outermost surface of the projection 66 has a curved configuration complementary to and following the inner wall surface of the lower right hand quadrant of the section 14, at its projected extremity. The uppermost surface 67 of the projection 66 is planar and lies in a horizontal diametral plane of the section 14, at which point the projection 66 has its greatest radial extent. As may be seen from the drawings, the radial innermost edge of the upper extremity of the projection 66 effectively forms an axial extension of the radially innermost surface portions of the tube segment 36 and blends into a surface portion of the back wall 62 at its uppermost edge which forms, likewise, an axial extension of the innermost surface of the segment 36. The construction in this last respect insures that on projection of the shaft 40 and its bearing sleeve 38 through the tube segment 36 and the extension thereof so provided that the helical developed wall surface 62 and the projection 66 will wrap immediately around the bearing sleeve and contribute to defining therewith a defined path for the material to be refined which passes through the passage 24 to exit therefrom over the helically developed forwardly facing wall surface of the wall 62 between the partition 68 closing off one end of the discharge channel so provided and the projection 66 closing off the other end thereof. This leaves an arcuate opening from the section 14 between the face of the segment 68 remote from that facing the material being delivered for refining purposes and the uppermost planar surface 67 of the projection 66 to the lowermost end of the vent passage 26 in the section 12, the innermost surface of this arcuate opening being defined by the sleeve 38 and the radial outermost surface by the inner wall surface of the tube segment providing the section 14.

Figure 3:
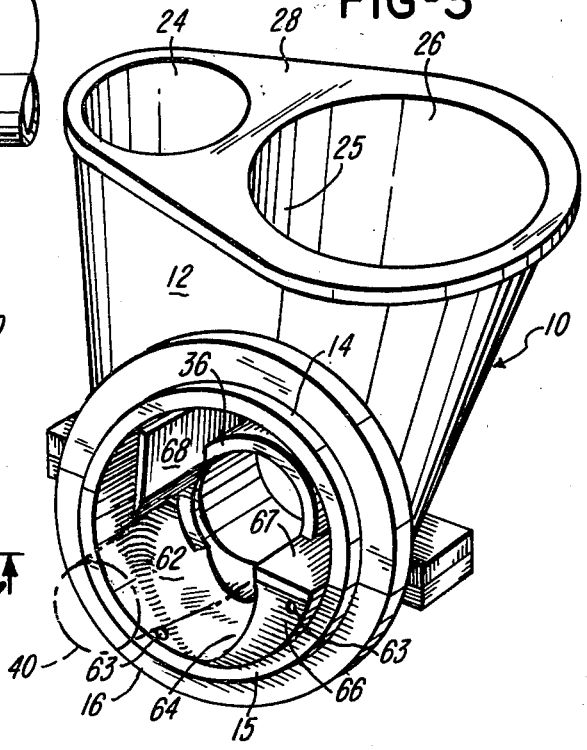
FIG. 3 is a perspective view of the infeed tube highlighting important detail.
Figure 4:
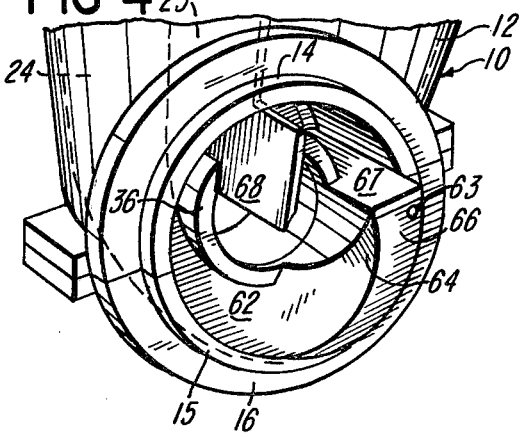
FIG. 4 is a further perspective view showing infeed tube detail.
Figure 5:
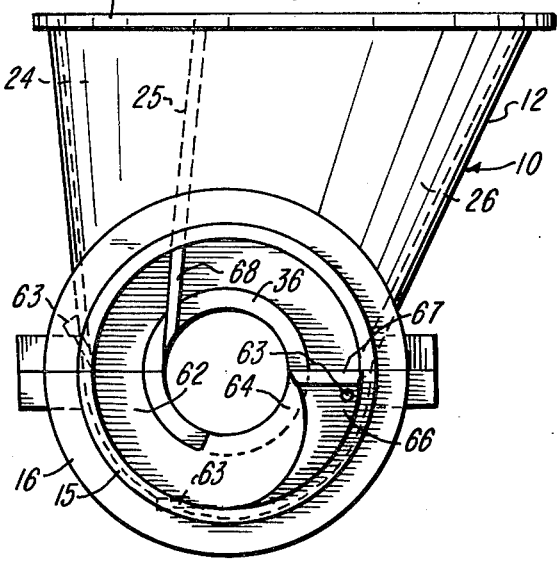
FIG. 5 is a view taken on line 5—5 of FIG. 1.
Figure 6:
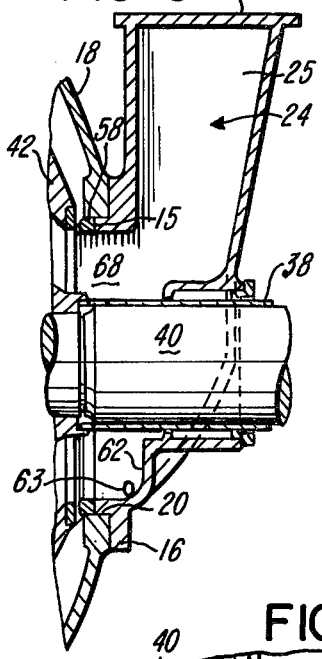
FIG. 6 is a view taken on line 6—6 of FIG. 2.
Figure 7:
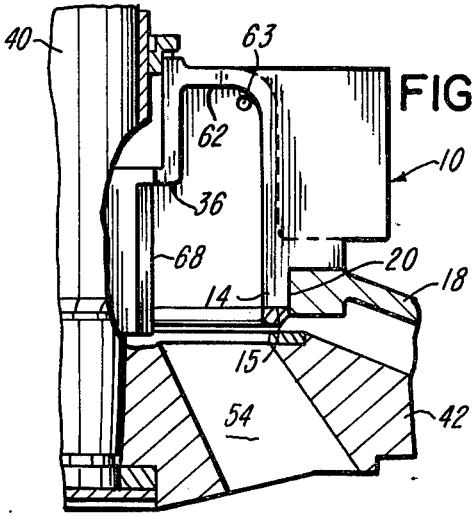
FIG. 7 is a view taken on line 7—7 of FIG. 2.
Figure 8:
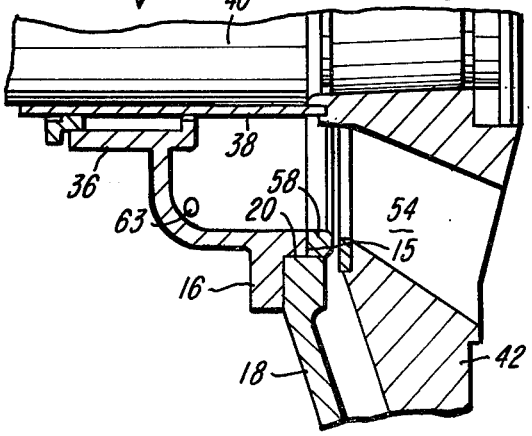
FIG. 8 is a view taken on line 8—8 of FIG. 2.
Figure 9:
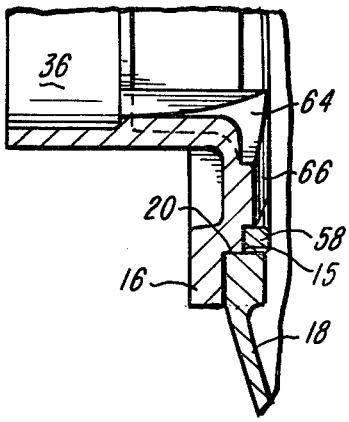
FIG. 9 is a view taken on line 9—9 of FIG. 2.

It will be seen, of course, from FIG. 3, that the helically developed forwardly facing surface of the back wall 62 of the section 14 which is limited as to its area and extent is so configured as to rapidly reduce the axial extent of the circular side wall of the discharge end of the passage 24 in the section 14, from the point of its communication with the lower end of the portion of the passage 24 in the section 12.

Incorporated in connection with the body of the section 14 are jet nozzles 63. These nozzles function to deliver water to material moving from the section 12 portion of the passage 24 in a sense tangentially of the flow thereof in a manner to exert a positive influence on such material to approach and move from the section 14, by way of the helically developed surface portion thereof, directly to and through infeed passages 54 in the refiner to which the infeed tube is applied. One such nozzle 63 is located at the juncture of the helically developed surface provided by the wall portion 62 with the immediately preceding surface defining the discharge end of the vertical portion of the passage 24 in the section 12. A second such nozzle 63 is applied to discharge to the flow at a point along the helically developed discharge surface for the material which is 90° from the first of said nozzle and a third such nozzle is arranged to open 180° from the first said nozzle, through the projected upper extremity of the projection 66.

Figure 2:
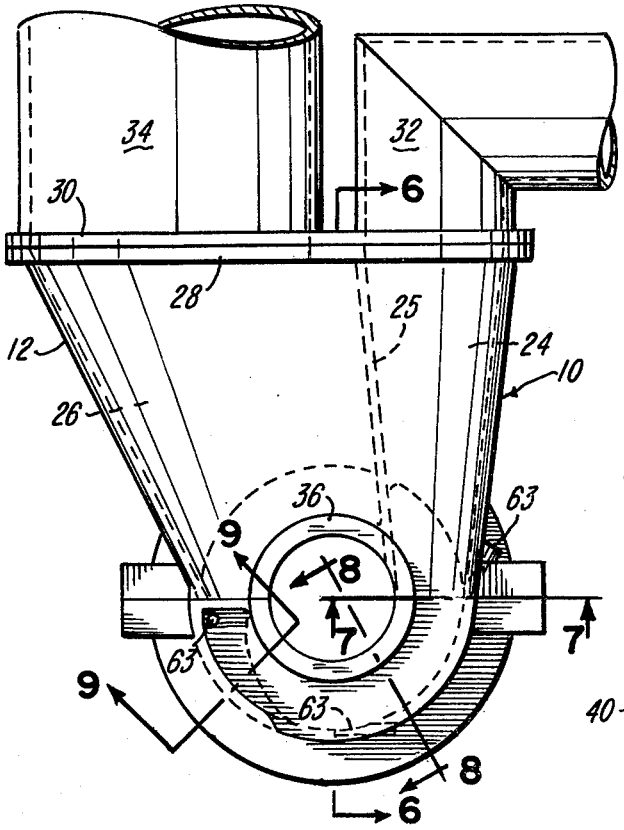
FIG. 2 is a view taken on line 2—2 of FIG. 1.

Looking into the section 14 of the body of the infeed tube 10 it would appear that the discharge end of the passage 24 has a scroll-like configuration. In operation of the tube 10, as seen in FIG. 2, the feeder 32 is connected for gravity discharge of the material to be refined to the upper expanded end of the passage 24. As this material enters the passage 24, it moves downwardly thereof under the influence of gravity, in the process being gradually restricted as to the cross section of its flow. As the material moves to the lower end portion of that section of the passage 24 located in the section 12, its flow pattern will be influenced by the development of a spirally curved lower wall portion of the passage. The latter merges with the forwardly facing helically developed surface of the wall 62 producing thereby a smooth rapid helical pattern of the movement of the material the flow of which is assisted by the influence thereon of gravity. By such means and the provision for the continuation of the helical flow on the side surface portion of the projection 66 the material will rapidly flow to and through the opening defined by the projected extremity 15 of the section 14 and to the rear material receiving face of the disc 42 of the refiner to which the infeed tube is applied. The configuration of the scroll-like discharge surface and the arrangement that it opens laterally to the general influence of the centrifugal force developed by the rotation of the disc 42 facilitates the full and positive insuction and movement of the material to be refined to and through the passages 54 for discharge to the refining surfaces of the refiner discs. Particular importance lies in the fact that the material being fed, if not incidentally previously picked up, will actually reach the infeed face of the refiner disc 42 so that the centrifugal force developed by the disc will have maximum influence on the material to be refined. The jet nozzles 63 are safety features which insure that no material will inadvertently accumulate or stick within the infeed tube 10.

Also important in the invention embodiment are the improvements afforded by reason of the projection of both the plate extension 68 and the projection 66 to a plane immediately of the infeed face of the rotating disc 42. Inherently, in view of the fact that in assembly of the infeed tube the shaft 40 and its bearing sleeve must project through the sections thereof and centrally of the discharge end 15 of the section 14, the configuration of the infeed tube is such that one very simply and automatically achieves a separation of the scroll-like or helically developed flow surface of the wall 62 and the projection 66 from that portion of an annular opening about the shaft 40 in which they are positioned which communicates with the lower end of the steam vent passage 26.

As seen in FIG. 2, the uppermost expanded discharge end of the steam vent passage 26 communicates with a discharge line 34 by way of an aperture in a plate 30 which is fixed to overlie and seat to the upper end of the tube 10. As will be obvious, the plate 30 has a further aperture by means of which the feeder device 32 communicates with the entrance end of the passage 24.

The arrangement described dictates that by reason of the pressure differentials in the passages 24 and 26 that the steam escaping through the infeed passages 54 reversely to the material being fed will seek the entrance to the vent passage 26 over the top of the shaft 40 and be inhibited from escape to and through the passage 24. In this last respect, there would be greater resistance to movement of steam through the passage 24 reversely of the material flow by reason of the character and restriction thereof as well as the high velocity the material flow induced by the convergence of the passage and the scroll-like form of its discharge end. Should, by any chance, material inadvertently enter the lower end of the steam vent passage 26, the pressure therein will prevent any rapid movement thereof and accordingly the material which is heavier than the steam will be influenced to return to the infeed passages 54 under the influence of the centrifugal forces developed in rotation of the disc 42.

It will be readily seen, therefore, that the improvements of the invention facilitate the escape of steam from the refiner in a path which the steam will inherently follow by reason of the operation of the refiner. No effort is made to divert the steam but rather to direct the steam in the course of its natural flow so that it will exit through a defined outlet which is in an opening common to but separated from that discharge opening from the infeed tube for the material which is fed to the infeed passages 54.

The incidence of potential interference of the movement of the material being fed by reversely flowing steam inherently developed in operation of the refiner is thereby minimized. Further, the fact that the steam escaping will be relatively free of any stock particles, enables that it may be used for many applications within the requirements of refining purposes.

One most important point is that the ease and effectiveness of material feed is provided by the improvements of the invention will enable in the use thereof a much less expensive and less complex feeder.

I claim:

1. An infeed structure for application to the inlet opening of a refiner including a body having two passages, each of said passages having an entrance opening and an exit opening, the entrance opening of one of said passages and the exit opening of the other of said passages being located to commonly open directly from a portion of said body constituting an adapter formed to bridge the inlet opening of the refiner to which it is applied, one of said passages being a material infeed passage and the other thereof being a steam vent passage, and separator means which in the application of said adapter to the inlet of a refiner define separate channels one of which is a material discharge channel forming part of and providing the discharge end of the material infeed passage and another of which is a steam vent channel forming part of and providing the entrance end of said steam vent passage to provide a controlled and directed flow of the material fed through and from said material infeed passage by way of its exit opening in a path distinctly and positively separated from the entrance opening to said steam vent passage, which lies adjacent thereto.

2. An infeed structure as in claim 1 wherein said body is a generally tubular structure which is bent intermediate its ends to include one portion which has a generally vertical orientation in the connection thereof to a refiner and a second portion which extends laterally of said one portion and provides said adapter, and the discharge end of said material infeed passage is helically configured.

3. Apparatus as in claim 1 wherein said body is a vertically orienting structure and the discharge end of said infeed passage is arranged to open laterally thereof to the inlet opening of the refiner to which the infeed structure is applied, along a surface portion of said adapter which forms a portion of said infeed passage which is arcuately configured the arcuate extent of which is about 180°.

4. Apparatus as in claim 1 wherein said vent passage has a cross sectional area which is substantially greater than that of said material infeed passage and said vent passage is expanded at its discharge end.

5. Infeed structure as in claim 1 wherein both said passages are reduced in cross section from one end thereof to the other and have their greatest cross sectional area at their ends remote from said adapter.

6. Apparatus as in claim 1 wherein said body of said infeed structure has a major portion thereof arranged for disposition in a generally vertical sense and a lesser portion thereof bent to extend laterally of said major portion and said lesser portion embodies said adapter.

7. An infeed structure as in claim 6 wherein said lesser portion of said body embodies partition means serving in the application of said infeed structure to the inlet of a refiner to provide said separation means.

8. Apparatus as in claim 6, for a disc refiner, wherein said major portion of the body of said infeed structure has an aperture therein which is in coaxial alignment with an opening through said lesser portion to accommodate the projection therethrough of a refiner disc drive shaft, an annular space being defined in said lesser portion which is backed in part by a helically developed flow surface connected to form an extension of the lower end of that portion of the infeed passage which is provided in said major portion of the body of said infeed structure.

9. An infeed structure as in claim 1 wherein said separator means includes a partition means which separates said passages and an extension of said partition means serves as a divider which inhibits material moving out from said infeed passage from entering said vent passage.

10. An infeed structure as in claim 1 wherein said portion of said body constituting an adapter is a tubular structure constructed and arranged for the projection therethrough of a shaft for mounting a disc in the refiner to which said infeed structure is applied, and the discharge end of said infeed passage and the entrance end of said vent passage are arranged to encircle the shaft projected through said tubular structure with said separator means therebetween.

11. An infeed structure as in claim 10 wherein said separator means include means defining projections from the interior of said adapter which serve as dividers which separate the discharge end of said infeed passage from the entrance end of said vent passage.

12. An infeed structure for a disc type refiner including a tubular body having a plurality of through passages, one a material infeed passage and a second a steam vent passage, each of said passages having an entrance end and a discharge end, said material infeed passage having a portion of generally helical configuration and its discharge end and the entrance end of said vent passage being in an adjacent but separated substantially side by side relation thereto.

13. An infeed structure as in claim 12 wherein said discharge end of said material infeed passage is exposed at one side of said tubular body and said exposed discharge end is embodied in means for application to the infeed opening of a disc refiner.

14. An infeed structure as in claim 12 wherein the entrance end to said steam vent passage has a circularly spaced relation to the discharge end of said material infeed passage and said entrance end to said steam vent passage and said discharge end of said material infeed passage are commonly exposed at one side of said tubular body.

15. An infeed structure as in claim 12 wherein said discharge end portion of said infeed passage faces outwardly of an adapter in connection with said body enabling the application of said tubular body to the inlet of a disc refiner and said discharge end portion which has a generally helical configuration is continued on means defining an axial projection from said adapter, the arrangement providing that said projection will in the application of said tubular body to the inlet of a disc refiner position in immediate adjacent relation to the entrance ends of infeed passages provided in the infeed disc of the refiner to which said tubular body is applied.

16. An infeed structure as in claim 12 in combination with a refiner including a housing having means defining an inlet thereto and containing means coaxial with said inlet providing a pair of opposed relatively closely spaced refining surfaces, one of said coaxial means comprising an infeed disc having at least one infeed opening the entrance end of which faces said inlet, said body being applied to position said helically developed discharge end of said infeed passage and said entrance end of said vent passage both in adjacent relation to said infeed opening in said disc and in communicating relation therewith.

17. Apparatus as in claim 16 wherein partition means separates said passages within said tubular body, and said partition means include extensions adapted to project through said inlet to a plane immediately adjacent that portion of said infeed disc including the entrance end of said infeed opening, a shaft mounts said infeed disc and projects outwardly of said housing through the center of its inlet and a portion of said tubular body and said helically configured discharge end portion of said infeed passage is developed to extend about a portion of said shaft and the extremity of said helically developed discharge end portion is projected to the interior of said inlet and to the aforementioned plane to provide a portion of said partition means which define a spacing and separation of said discharge end of the material infeed passage and the entrance end of said vent passage.

* * * * *

UNITED STATES PATENT AND TRADEMARK OFFICE

CERTIFICATE OF CORRECTION

PATENT NO. : 4,132,366

DATED : January 2, 1979

INVENTOR(S) : Fred Engall

It is certified that error appears in the above–identified patent and that said Letters Patent are hereby corrected as shown below:

Col. 4, line 6, -- means -- is inserted following "bearing".

Col. 7, line 68, "is" is corrected to read -- as --.

Col. 8, line 59 (Claim 7, line 4) "separation" is corrected to read -- separator --.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*